United States Patent [19]

Harwath et al.

[11] Patent Number: 4,740,180

[45] Date of Patent: Apr. 26, 1988

[54] LOW INSERTION FORCE MATING ELECTRICAL CONTACT

[75] Inventors: Frank A. Harwath, Downers Grove; Paul L. Rishworth, Chicago, both of Ill.

[73] Assignee: Molex Incorporated, Lisle, Ill.

[21] Appl. No.: 25,917

[22] Filed: Mar. 16, 1987

[51] Int. Cl.[4] ..... H01R 13/11

[52] U.S. Cl. ..... 439/856; 439/884; 439/885

[58] Field of Search ..... 439/830, 834, 842, 845, 439/848, 850, 856, 857, 861, 862, 884, 885, 889, 891, 894

[56] References Cited

U.S. PATENT DOCUMENTS

| | | | |
|---|---|---|---|
| 3,281,760 | 10/1966 | Oshima et al. | 439/868 |
| 3,588,862 | 6/1971 | Brizzi | 439/869 |
| 4,175,821 | 11/1979 | Hunter | 439/856 |
| 4,241,970 | 12/1980 | Rider, Jr. et al. | 439/856 |
| 4,607,907 | 8/1986 | Bogursky | 439/856 |
| 4,679,890 | 7/1987 | Fineblum | 439/884 |

*Primary Examiner*—Eugene F. Desmond

*Assistant Examiner*—Paula A. Austin

*Attorney, Agent, or Firm*—John W. Cornell; Louis A. Hecht

[57] ABSTRACT

A low insertion force mating electrical contact structure is provided in a male terminal including a final contact portion and a forwardly extending lead-in portion having a gradual twisted cross section relative to the final contact portion. In a preferred embodiment, the male terminal is adapted to mate with a dual contact cantilever spring arm female terminal. Opposed smooth-milled surfaces on the male terminal extending through the lead-in portion to the final contact portion engage the female contact portions and gradually cam the female contacts outwardly to provide reduced insertion forces on the male pin during insertion. Varying the rate of change in the twist along the lead-in portion can define camming surfaces on the male terminal effective to substantially reduce the lifting force component of the insertion force so that the peak insertion force for the mating contact structure approaches only the frictional sliding force between the male and female contact portions, associated with the final stages of insertion and mating.

8 Claims, 5 Drawing Sheets

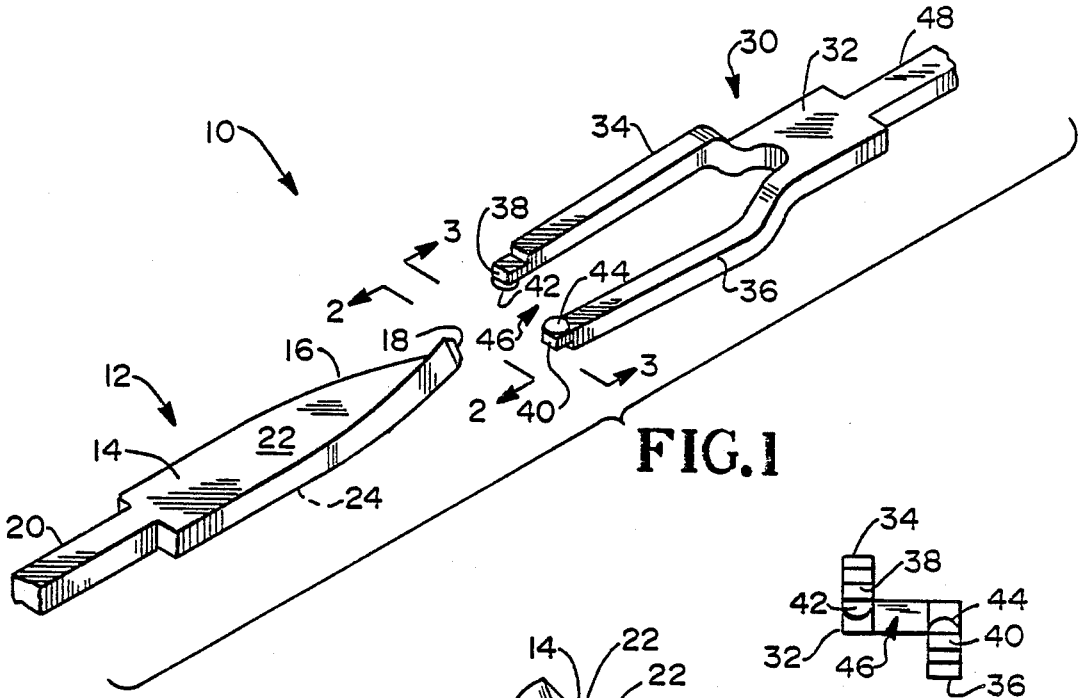
FIG.1
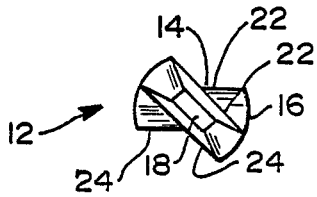
FIG.2
FIG.3
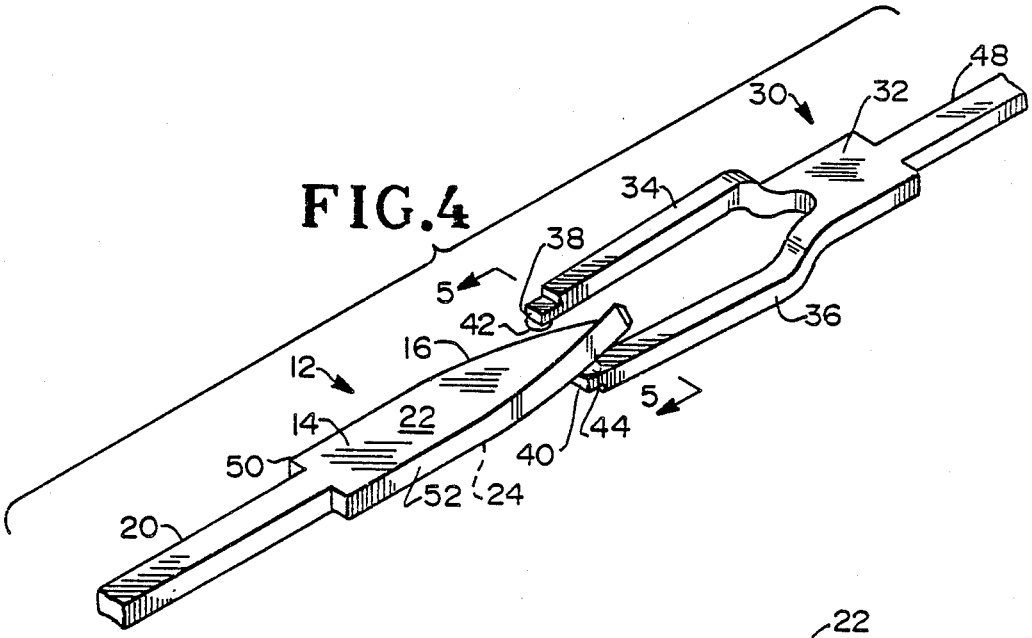
FIG.4
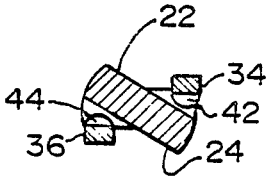
FIG.5

FIG. 20 CALCULATED INSERTION FORCE IN GRAMS VS INSERTION DEPTH
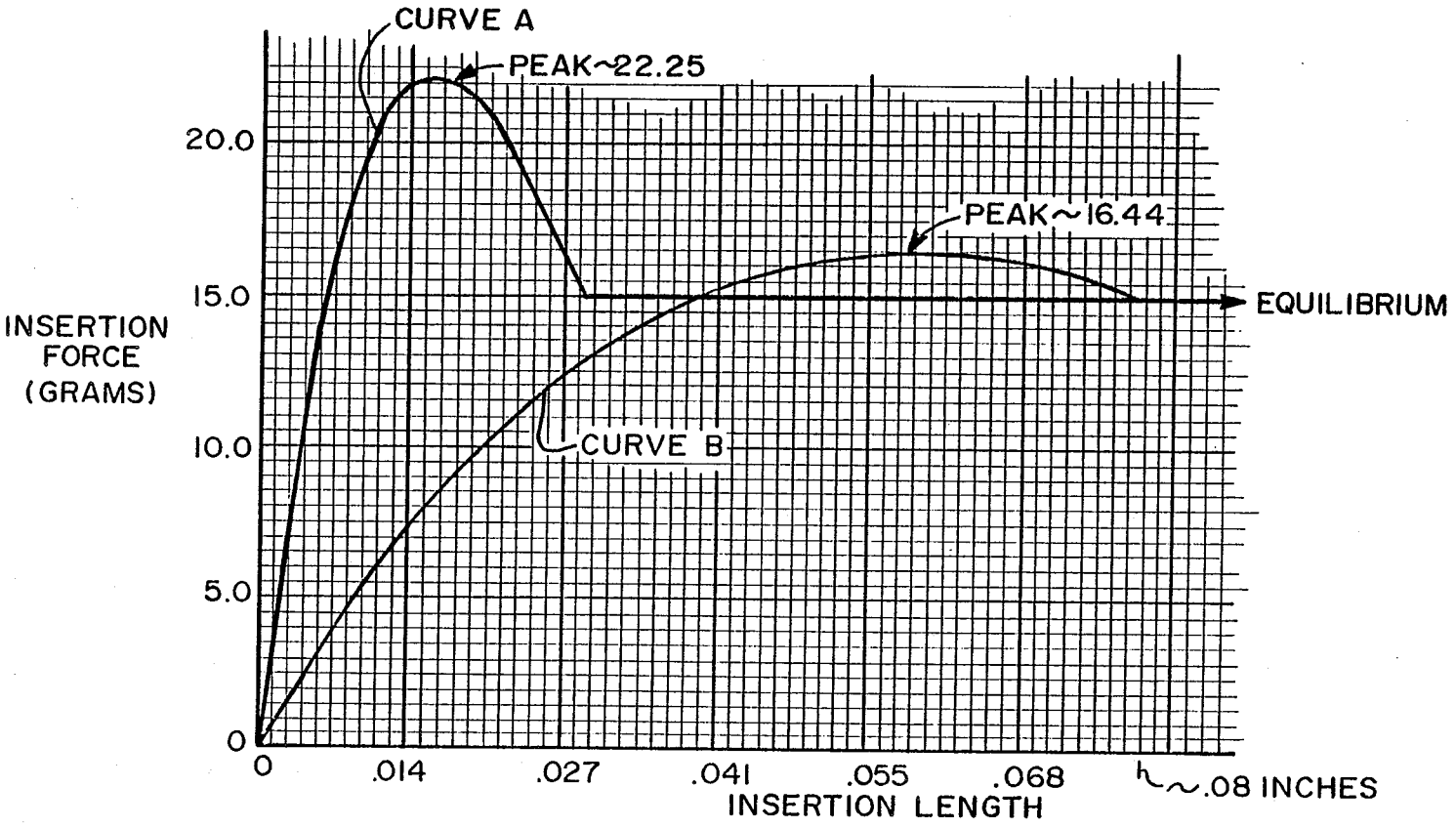

LOW INSERTION FORCE MATING ELECTRICAL CONTACT

BACKGROUND OF THE INVENTION

The present invention relates to low insertion force mating male and female electrical contact structures and to electrical connectors incorporating them. More particularly, it relates to a low insertion force contact structure including a male terminal having a twisted lead-in portion with at least one surface adapted to engage at least one contact of a female terminal which is effective to gradually deflect the contact portion of the female from an initial position to a final mated position during insertion to provide a lower overall insertion force.

Various single and dual spring arm female contact electrical terminals have been provided in the past for making electrical contact with male terminals such as pins, blades, edge card contact pads and the like. Generally, in these arrangements, the male terminal must be inserted into the female with sufficient force to overcome the resistance to insertion presented by the female terminal. The insertion force of the contact structure includes a lifting component which represents the force required to lift or spread the female contact portions apart to permit passage of the male terminal into the female and also a horizontal frictional component provided as the female contact portions wipe against the male terminal during the insertion.

In multicircuit arrangements including a large number of female terminals mounted in a connector adapted to mate with a male connector including a correspondingly large number of male terminals, the individual insertion forces associated with each pair of contacts combine so that the overall insertion force required to mate the male and female connectors can be extremely large.

Earlier efforts to provide an electrical contact structure characterized by reduced insertion force have generally included modifying the female terminal contacts. In U.S. Pat. No. 4,175,821, for example, a female terminal is disclosed including a dual opposed spring arm contact member wherein the contact portions of the opposed arms are axially offset from one another in the longitudinal direction. As the pin contact is inserted between the female spring arms, the pin engages the first spring arm on the female and lifts it out of the way, before contacting the second spring arm and moving that contact out of the way. A lower peak insertion force is provided by the arrangement because the lifting force needed to deflect the female to a final mated position is broken down into two smaller lifting steps, lifting one spring arm at a time during the insertion stroke instead of two at a time. The design described in the patent has several shortcomings. For example, the female terminal is adapted to receive a conventional square pin male terminal which includes a relatively short, chamfered tip portion. The tip portion of the male terminal typically is a rough machined surface which wipes against the precious metal plated contact portion on the female. Repeated mating results in abraided contacts which tends to make the contact arrangement electrically unreliable in prolonged use. Increasing the precious metal plating in the contact area results in increased cost which is also undesireable.

Another modified low insertion force female terminal is disclosed in U.S. Pat. No. 4,607,907. The female contact in this patent is a stamped and formed terminal including a rearward box member from which extend cantilevered spring arms including contact portions at their free ends. The contact portions are axially longitudinally offset as were the contact portions in the aforementioned patent, but in addition, they are configured so that they overshoot the midline of the insertion region which permits lower spring rates to be used. The female contact further includes horizontal spacing between the cantilevered spring arms so that the contact portions are horizontally spaced one from the other. This permits the contact portions to be plated with precious metals in a lower cost process. This female contact provides a lower peak insertion force for the same reasons, i.e. the male lifts one cantilevered spring arm at a time during insertion. The overshot design of the contact portions permits lower spring rates in the spring members to be used, so that the stiffness of each spring member is reduced and the force required to lift each spring arm contact during pin insertion is reduced.

This design also possesses several shortcomings. As with the first mentioned female, the rough cut abrasive edge of the chamfered lead-in on the male pin scrapes against the precious metal coated contact portions of the spring arms during pin insertion. Long term electrical reliability in repeated mating operations is generally not obtained. The female terminal is stamped and then formed in a manner which produces a significantly large amount of wasted sheet metal stock. Furthermore, because these female terminals are formed after stamping to provide the box portion and opposed spring arm structure, they cannot be provided on a carrier strip spaced apart by centerline spacings adapted for ready insertion in a connector housing in a single stamping operation. Instead, after they are formed, they must be repositioned to a spacing appropriate for insertion into a housing. This requires additional manufacturing and assembly steps in use.

A new approach to providing a low insertion force contact is disclosed in copending U.S. application Ser. No. 912,887, filed Sept. 26, 1986. The mating electrical contact structure described therein includes an electrically conductive elongated tubular female receptacle adapted to receive a mating male contact. The male contact has at least one resilient elongated beam. Either the female tubular receptacle or the male terminal includes a predefined longitudinally extending rotational skew or twist profile. As the male terminal is inserted into the female receptacle, the resilient beam on the male terminal is progressively deflected along the predefined rotational skew. In accordance with the design, the rotational deflection provides a torque which generates the mated contact force between the male and female contacts. The degree of the rotational skew in this contact arrangement determines the amount of progressive deflection during insertion.

The proposed design also has some shortcomings. The male terminal member in at least one embodiment must be assembled and the additional assembly steps add to the cost of the contact structure. Another disadvantage in manufacturing is encountered because the interior of the tubular female member is extremely difficult to plate with precious metals satisfactorily after it is formed. The opposed inner surfaces will create field effect interference in plating operations, resulting in poor or lower quality plating. Moreover, the contact design structure is very sensitive to misalignment of the mating female and male terminals. If the male terminal member is positioned to be slightly offset from the central axis of the tubular female, the low insertion force characteristics can be changed into very high insertion forces because a misalignment will tend to deflect or try to deflect nonresilient members in the system.

SUMMARY OF THE INVENTION

Accordingly, it is an object of the present invention to provide a new and improved low insertion force mating electrical contact structure characterized by having a peak insertion force associated with the beginning phases of insertion which is not significantly larger than the frictional wiping forces associated with the final stages of insertion between the contact surfaces of the male and female terminal.

It is another object of the present invention to provide a reliable mating electrical contact structure adapted to resist wear after periods of extended use.

It is a further object of the present invention to provide a new and improved low insertion force mating electrical contact structure which may be manufactured by streamlined stamping and planting operations which do not involve high precious metal consumption nor produce excess material waste.

In accordance with the present invention, a new and improved low insertion force mating electrical contact structure is provided in a contact structure including a male terminal and a female terminal having at least one spring arm with a contact portion adapted to electrically engage at least one opposed surface of the male terminal, the improvement comprising:

said male terminal including a final contact portion joining a forwardly extending lead-in portion, said lead-in portion having a gradual twisted cross-section relative to said final contact portion, said spring arm contact portion slidingly engaging said surface of the lead-in portion as the male terminal is initially inserted into the female terminal, said lead-in surface being effective to increasingly deflect the contact portion of the spring arm as the male terminal is inserted therein, from an initial position to a final position when the female contact portion is on the final contact portion of the male terminal, whereby the normal forces between the contact portion of the spring arm on the surface of the male terminal gradually increase, as the male terminal is inserted into the female terminal until a final mated position is achieved.

The twisted configuration of the lead-in portion of the male terminal of the present invention provides an effective slope which is greatly reduced compared to standard chamfered square pin terminals, for example, and the reduced effective slope is achieved without material weakening caused by providing an excessively long chamfered region. Instead, the male terminal is substantially rigid, small and robust and may be stamped on centerlines in a single operation at a terminal spacing readily suited for final insertion in a connector housing. The stamping operation provides an extremely low waste, easily plated structure.

In accordance with a preferred embodiment, the female comprises a dual opposed cantilever spring arm terminal and the final normal contact pressure required for good mated electrical contact between the male and female terminal is solely determined by the thickness of the male terminal in the final contact portion. The twist of the lead-in portion of the male terminal of this invention provides low insertion force during insertion, but is not responsible for the formation of the final electrical contact pressure of the mated contact structure. The lead-in slope on the male terminal contact of this invention can be designed in a manner which effectively lowers the lifting force during insertion, so that the peak insertion force required to mate the male terminal does not significantly rise above the frictional wiping force associated with the final stages of insertion.

When the pin is twisted in accordance with the preferred embodiment, a smooth-milled surface on the male terminal is presented to the female contact surface throughout the entire insertion. This ensures that rough cut abrasive edges on the male pin are not in contact with the mating surfaces of the female, which reduces wear on the female contacts.

In addition, the twist configuration in the lead-in portion of the male terminal is generally effective in opposing cantilever contacts to force any debris on the female contact outwardly away from the final mated contact surfaces, much like a wood screw.

The new and improved male terminal including the twisted lead in portion is relatively easy to fabricate. The final thickness of the male terminal in the contact portion can be milled to very close dimensional tolerances. The twist angle of the lead in portion is relatively noncritical and usually can vary widely without penalty. In alternate embodiments, the male terminals may also be formed from wire stock.

In accordance with a preferred embodiment, the contact portions on the cantilever spring arms of the female member are generally coplanar and laterally offset with respect to each other to provide an insertion gap therebetween adapted to receive the lead-in portion of the male terminal. The preferred female contact will contact the twist pin on smooth milled or coined contact surfaces so that it is less susceptible to wear to provide increased reliability.

The preferred female terminals can also be manufactured on high speed stamping equipment in a manner which reduces material usage and makes selective plating possible, unlike prior, directly opposed, tuning fork type contacts. The preferred female terminals of this invention by virtue of their laterally spaced configuration, can be plated with improved reliability and speed. Current density is not reduced in the contact areas because the contact areas do not directly face each other. The female contact areas may also be brush plated in a less expensive plating operation. The female terminals may also be stamped from preplated stock and retain their plating in the contact area.

In accordance with the preferred embodiment, the female contact can accommodate very broad X, Y-type pin placement errors, without altering the insertion force of the contact structure for the worse. In accordance with alternate embodiments, the low insertion force male terminal of this invention may advantageously be employed with conventional dual opposing cantilever female contact terminals to provide reduced insertion forces during mating.

Other objects and advantages of the present invention will become apparent from the following detailed description taken in conjunction with the drawings in which:

BRIEF DESCRIPTION OF THE DRAWINGS

FIG. 1 is a perspective view of the preferred new and improved low insertion force mating electrical male and female contact structure of the present invention;

FIG. 2 is a front elevation view of the new and improved male terminal of this invention taken along line 2—2 in FIG. 1;

FIG. 3 is a front elevation view of the new and improved preferred female contact structure of the present invention taken along lines 3—3 of FIG. 1;

FIG. 4 is a perspective view of the new and improved electrical contact structure of the present invention at the beginning stages of insertion of the male terminal into the female terminal;

FIG. 5 is an elevated sectional view of the beginning stages of insertion taken along line 5—5 in FIG. 4;

FIG. 20 is a plot graphically comparing calculated insertion force required during insertion of a conventional contact structure (Curve A) and for the new and improved contact structure of this invention (Curve B) as as function of insertion length.

DETAILED DESCRIPTION OF THE PREFERRED EMBODIMENT

Figure 6:
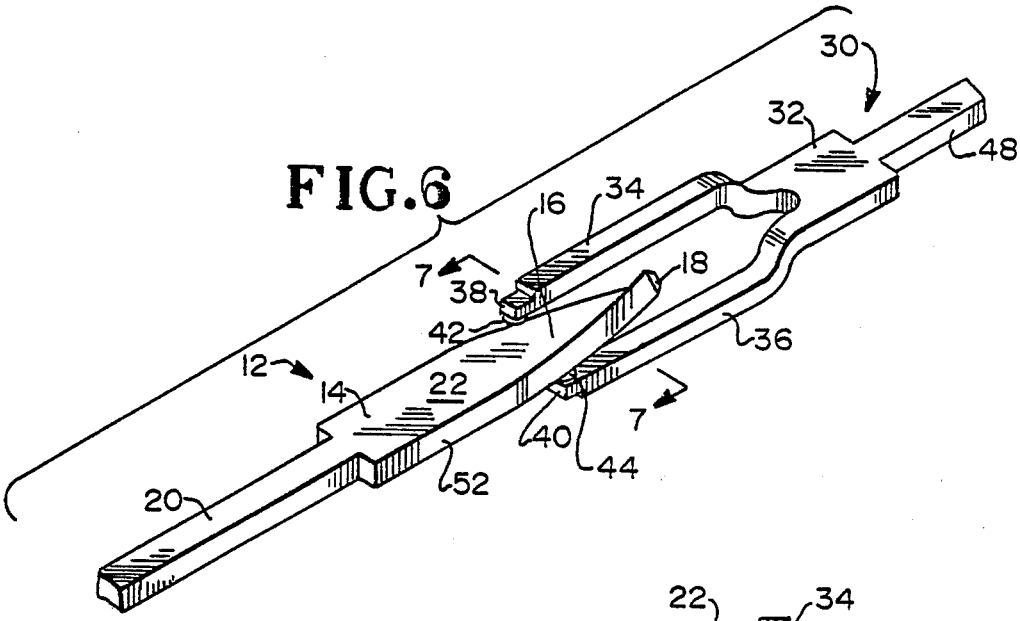
FIG. 6 is a perspective view of the male and female terminal at an intermediate point during insertion of the male terminal into the female terminal.

Referring now to FIG. 1, a preferred embodiment of the new and improved low insertion force mating electrical contact structure 10 of the present invention is shown. Mating contact structure 10 firstly comprises a male terminal 12 including a final contact portion 14 and a forwardly extending lead-in portion 16 having a gradual twisted cross-section relative to final contact portion 14, as shown in FIGS. 1 and 2.

In the preferred embodiment of the male terminal 12 shown in FIGS. 1 and 2, the forward free end of lead-in portion 16 is provided with a small chamfered tip 18. A second contact portion 20, such as solder tail or pin as shown, adapted to engage an external circuit member extends rearwardly from final contact portion 14.

Male terminal 12 as shown, has a generally four-sided cross sectional configuration including a pair of opposed major surfaces 22 and 24 extending from the rearward end of final contact portion 14 to the forward end of lead in portion 16 immediately adjacent tip portion 18. Male contact surfaces 22 and 24 are smooth, continuous milled surfaces which have not been made abrasive by cutting or machining operations. Surfaces 22 and 24 in the lead-in portion 16 each provide a smooth continuous camming surface for moving deflectable contact portions of the mating female contact gradually increasingly further apart as the male terminal is matably inserted into the female terminal, in a manner to be more particularly described hereinafter.

Male terminal 12 is a substantially rigid, unitary integral metallic stamping which may be readily and inexpensively prepared using conventional metal stamping and coining methods and equipment, well known to those skilled in this art.

More particularly, stamped male terminals 12 are formed by stamping sheet metal stock of desired thickness, preferrably in such manner as to include a carrier strip, and thereafter coining the twisted cross-section in lead-in portion 16, by contacting opposed surfaces 22 and 24 with upper and lower die forms having complementarily contoured surfaces designed to impart the desired twisted configuration to the lead in portion 16. The final contact portion 14 of male terminal 12 can be formed in the stamping step from pre-plated metal stock or, the final contact portion 14 may be selectively plated with precious metals after stamping, by brush plating or other plating methods.

Referring now to FIGS. 1 and 3, the preferred new and improved mating electrical contact structure additionally comprises a female terminal 30 adapted to matably receive male terminal 12. Female terminal 30 comprises an integral metallic stamping including a generally rectangular base portion 32 and forwardly extending from opposed sides of base 32 are a pair of laterally offset, vertically opposing cantilevered spring arms 34 and 36. Spring arms 34 and 36 are formed so that they extend first away from each other the adjacent base portion 32 and thereafter toward each other. The free ends 38 and 40 of spring arms 34 and 36, respectively, are coined to have raised contact portions 42 and 44 extending from the upper and lower opposed surfaces thereof, respectively.

As shown in FIGS. 1 and 3, the dual opposing spring arm configuration of female terminal 30 defines an insertion gap 46 extending between forward ends 38 and 40 and spring arms 34 and 36, respectively, to base member 32. As shown more particularly in FIG. 3, in unmated condition the opposing contact portions 42 and 44 of female terminal 30 are laterally spaced from each other but are substantially in-line horizontally. Female 30 additionally includes a second contact portion 48 such as a solder tail or pin as shown, which extends rearwardly from base portion 32, adapted to engage female terminal 30 with another external circuit member.

Female terminal 30 may also be prepared on conventional stamping and coining equipment. The lateral offset design between the contact portions 42 and 44, permits them to be reliably selectively plated with precious metals at high current density, without field density interference effects and related plating problems encountered with non-offset, vertically opposed contacts. Contact portions 42 and 44 may also be selectively plated by brush plating methods. Regardless of the plating method chosen, the configuration of female terminal 30 permits reliable selective plating to be provided with lower precious metal consumption. Preferably female terminal 30 is stamped to include an integral carrier strip to facilitate handling and subsequent connector assembly operations.

The low insertion force mating of the new and improved contact structure 10 provided by the present invention is illustrated in FIGS. 4–9. As shown in FIGS. 4 and 5, at the beginning stages of insertion, male terminal 12 is inserted between contact portions 42 and 44 into the entrance of insertion gap 46. Tip 18 and adjacent portions of twisted lead in 16 present the longer dimension of the rectangular cross section at an angled orientation with respect to final contact portion 14 on the male terminal, and with respect to female contact portions 42 and 44. At this insertion depth of the male terminal 12 into the female terminal 30, zero insertion force is encountered because the male terminal and female terminal do not touch.

Figure 7:
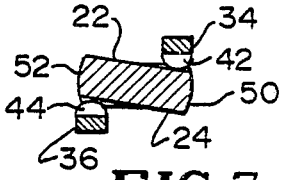
FIG. 7 is an elevated cross-sectional view of the male and female terminals of the present invention shown at the intermediate stage of insertion taken along lines 7—7 in FIG. 6.

FIGS. 6 and 7 show the relationship of the male and female terminals after insertion of the male terminal 12 to a point approximately one half the length of lead-in portion 16. At this insertion depth, the twist on the male terminal lead in portion 16 has presented the longer dimension of the rectangular cross section at successively smaller angular orientations with respect to the final contact portion 14 of the male terminal. In the process, major surfaces 22 and 24 have made contact with female contact portions 42 and 44. Upon further insertion, as the angular orientation of the cross section gradually changes, the contours of male surfaces 22 and 24 gradually lift contact portions 42 and 44 in opposed directions spacing them increasingly further apart.

As shown in FIG. 7, at the intermediate insertion depth shown in FIG. 6, the portions of major surfaces 22 and 24 adjacent the side edges 50 and 52 on the male terminal 16 have begun an oppositely acting outwardly camming action on contact portions 42 and 44 by exerting a substantially perpendicularly directed force against each contact and spring arm which is effective to deflect the contact portions to a position wherein they are at a greater distance apart.

Figure 9:
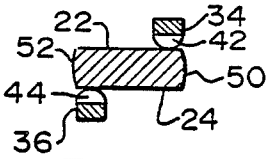
FIG. 9 is an elevated cross-sectional view of the fully mated male and female terminals taken along line 9—9 of FIG. 8.
Figure 8:
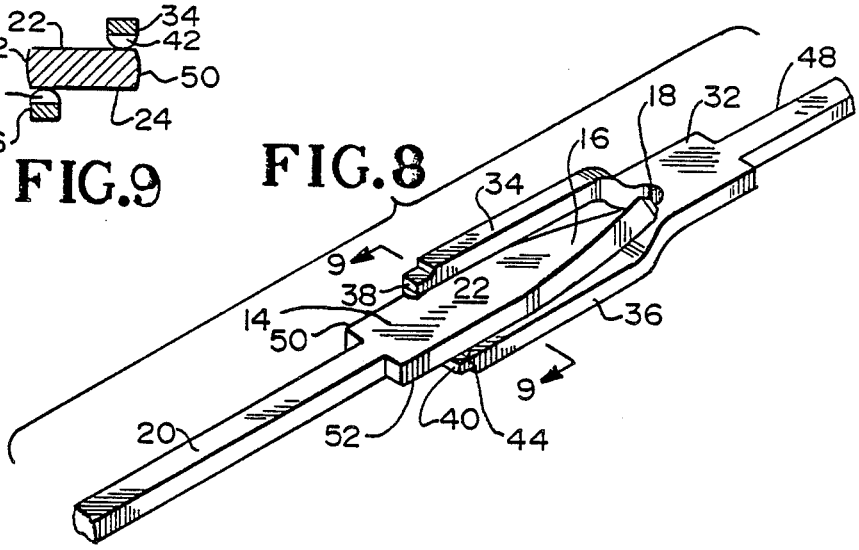
FIG. 8 is a perspective view of fully mated male and female terminals of the present invention.

Upon further insertion of male terminal 12 into female terminal 30, a final mating position is achieved, shown in Figs. 8 and 9. In the final mated position, female contact portions 42 and 44 have been slidingly cammed along male surfaces 22 and 24 to a position where they are now electrically engaging the opposed surfaces 22 and 24 of the final contact portion 14 of the male terminal 12. The angular orientation of the longer dimension of the male terminal cross-section has been reduced to about 0 degrees at the final contact portion 14. Female contact portions 42 and 44 have been outwardly deflected from zero distance apart to a distance generally equal to the shorter dimension of the cross-section, or thickness, of the male terminal.

The twisted lead in portion 16 on male terminal 12 has deflected the female contact portions 42 and 44 from a first distance apart to a second distance apart over smooth gradual slope, albeit a changing one, and throughout the later stages of insertion has exerted and outward deflecting force on the spring arms, acting in a substantially perpendicular direction on each of the lever arms of the cantilever springs. Moreover, the preferred male contact has exerted its camming action on the female contact portions by slidingly contacting the female contacts 42 and 44 with the smooth milled surfaces 22 and 24, thereby reducing the frictional component of the insertion force compared to a more abrasive machined surface such as a chamfer. These three elements combine in the preferred contact structure 10, shown in FIGS. 1–9 to provide a low insertion force contact.

A graphical illustration of the advantages in terms of low insertion force for the preferred electrical contact structure of this invention as compared to a conventional contact structure is provided in FIG. 20.

More particularly, FIG. 20 shows a plot of a simplified calculated insertion force as a function of insertion depth for a conventional contact structure including a radiused pin male terminal and a dual opposed cantilever spring arm female terminal and for the preferred contact structure 10 of the present invention including a twisted lead in portion 16 on the male terminal 12 and laterally offset opposed dual cantilever spring arm female terminal 30.

For each contact structure, the insertion force required for mating reaches an equilibrium at the point during insertion after the cantilever spring arms have been fully deflected, so that insertion force thereafter becomes substantially constant. At equilibrium, the insertion force is generally equal to the frictional sliding force of the male surfaces such as 22, 24 against the female contact surfaces 42, 44 at the final stages of insertion.

Each arm of each female contact was designed to have a spring rate of 8.33 grams/mil (0.001 inch) and to exert a normal contact force on the male terminal at equilibrium of 50 grams. The friction coefficient was 0.3.

The conventional male terminal was a radiused pin having a pin radius of 0.009 inches and a lead-in radius of 0.032 inches. The male terminal 12 of this invention was provided with a lead in portion 16 including 45 degrees of twist over 0.080 inches.

The simplified calculated insertion force in grams per tine at nominal dimensions is plotted as a function of insertion length in inches. The simplified calculation assumes a linear spring rate, but otherwise accurately describes the behavior of each contact based on geometry. Curve A shows the insertion force profile for the conventional contact and Curve B shows the insertion force profile for the preferred low insertion force contact structure 10 of the present invention.

Curve A illustrates that in the conventional contact arrangement, the insertion force required to insert the radiused male pin rises to a maximum along the radiused lead-in portion before declining to equilibrium along the straight shaft portions of the pin. The peak insertion force before the equilibrium value at the maximum in Curve A, representing the force required to lift the spring arms out of the path of the pin, was 22.25 grams.

In contrast, Curve B shows a more gradual increase in insertion force for the twisted male terminal 12 reaching a much lower maximum, further along in insertion, falling gradually to equilibrium.

Both systems achieved an equilibrium insertion force during final stages of insertion of about 15.0 grams. The peak above equilibrium for the conventional contact shown in Curve A was 7.25 grams, whereas the peak above equilibrium for contact structure 10 of the present invention shown in Curve B was 1.44 grams. The new and improved contact structure 10 of the present invention reduced the peak insertion force over equilibrium by more than 80%. In effect, the twisted lead in 16 on the male terminal 12 of this invention drastically reduces or substantially eliminates that component of the insertion force which is required to deflect the spring arms of the female increasingly further apart.

The amount of rotational twist provided on the lead in portion 16 for the male terminal 12 of this invention, as well as the effective length of the lead-in portion 16 will vary with design requirements presented by differing connector applications.

For example, if a particular normal contact force is required for making reliable electrical connection between the respective contacts 22 and 42, 24 and 44, a given thickness in the final contact portion 14 of the male terminal 12 will provide it. The insertion force which is required to insert the male terminal 12 into the female terminal 30 until the final mated engagement is achieved can be adjusted by lengthening the lead-in portion 16, or by varying the rate of change of the angular orientation of the longer cross sectional dimension of the male with respect to the longitudinal lead-in axis. In other words the rise over run or slope on the major surface 22 or 24 of the male pin 12, used to cam the spring arm female contacts 42, 44 to the final equilibrium, can be designed in accordance with this invention to provide a desired insertion force profile.

More particularly, in a simple case, the change in angular orientation of the longer dimension of the rectangular cross-section of the male terminal 12 with respect to the longitudinal axis of the lead-in portion 16 can be made constant. In this case, the contact path determined by the major surfaces 22, 24 of the male terminal 12 define an insertion force curve to equilibrium, similar to Curve B shown in FIG. 20.

In other applications, it may be preferable to vary the rate of change of angular orientation of the male terminal 12 along the lead-in axis to alter the insertion force profile. For example, it may be advantageous to provide a larger amount of twist at the forward section of the lead in portion 16 when normal forces are relatively low, which would be effective to rapidly deflect the female contact arms to an intermediate distance apart. Thereafeter, the rate of change in the twist for the remaining portion of the lead-in 16 can be varied to a very small change to gradually deflect the female contact arms from the intermediate to the final distance apart.

The insertion force profile curve for this latter male terminal 12 would rise steeply at the beginning stages of insertion to a level below equilibrium and thereafter gradually rise, substantially assymtotically to equilibrium. Expressed differently, by varying the effective slope of the major surfaces 22, 24 on the male terminal 12 through the lead-in portion 16 to the final contact portion 14, the insertion force profile can be altered.

In most cases, to avoid the creation of insertion force peaks or maxima, care should be taken in designing the lead-in portion 16 so that corners or shoulders on the major surface are avoided. The transition between the twisted lead in 16 to the final contact portion 14, for example, should include a tangential, radiused transition between the twisted lead-in 16 and the final contact portion 14 at the point where their surfaces intersect to avoid a peak or discontinuity in the insertion force profile.

As will be appreciated by those skilled in this art, many modifications of the twist profile can be designed to suit a wide variety of particular contact applications. In all cases, the normal mating force in the mated position between the female contact portions 42, 44 and the opposed surfaces 22, 24 of the final contact portion 14 will be determined solely by the cross sectional thickness of the male terminal 12 in the final contact portion. The twisted lead in 16 provides the reduced insertion force path to achieving the final mated position.

In accordance with the present invention, the new and improved low insertion force mated electrical contact structure 10 may be readily assembled in a connector to provide a low insertion force matable male and female connector structure.

Figure 10:
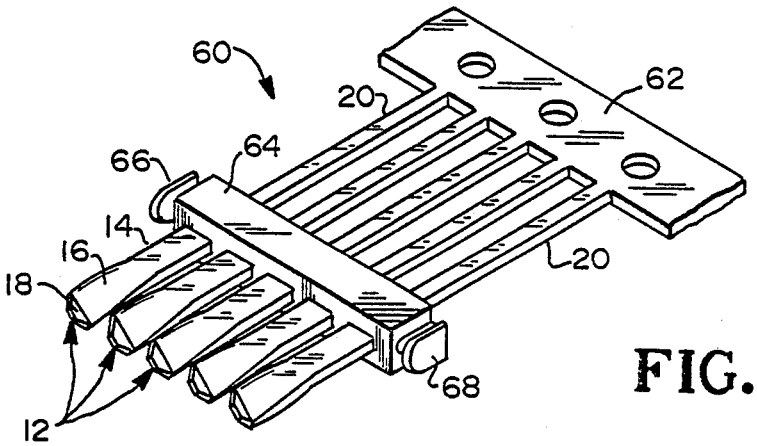
FIG. 10 is a perspective view of a carrier assembly including the new and improved male terminals of the present invention.
Figure 11:
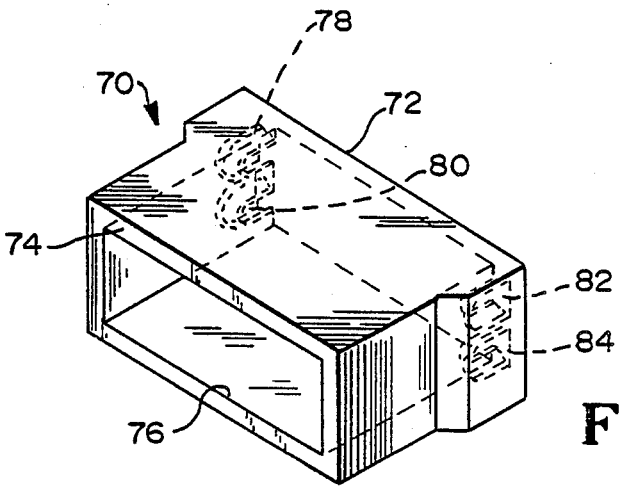
FIG. 11 is a perspective view of a connector housing prepared in accordance with the present invention adapted to receive the new and improved carrier assembly shown in FIG. 10.
Figure 12:
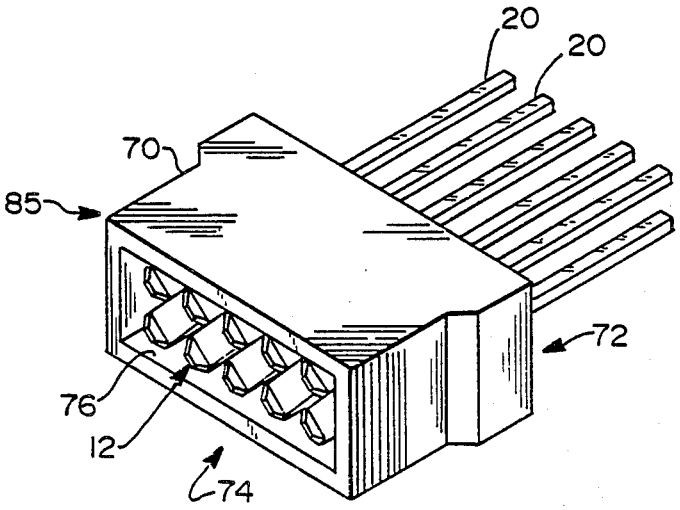
FIG. 12 is a perspective view of a fully assembled connector comprising a header connector of the present invention incorporating the new and improved male terminals therein.
Figure 13:
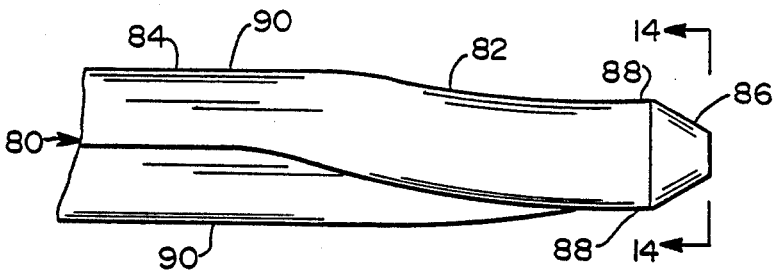
FIG. 13 is an elevated side view of an alternate male terminal in accordance with the present invention.
Figure 14:
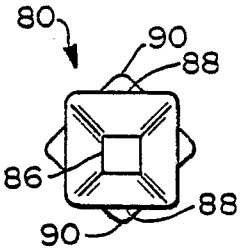
FIG. 14 is a front elevation view of the terminal shown in FIG. 13 taken along lines 14—14 thereof.

Referring now to FIGS. 10–12, in accordance with present invention, preferred twist pin male terminals 12 can be stamped and coined on conventional equipment to provide a male terminal carrier assembly 60 shown in FIG. 10. Carrier assembly 60 comprises an integral metallic stamping including a reelable carrier strip 62 which can be provided with indexing apertures as shown. Extending perpendicularly from one side of carrier strip 62 are a plurality of the preferred male terminals 12, attached at the rearward ends of second contact portions 20 along breakaway lines (not shown) which may be defined in the stamping and coining step. The twisted lead-in portions 16 of male terminals 12 extend forwardly from carrier assembly 60 opposite carrier tape 62. The male terminals 12 are spaced apart in carrier assembly 60 on centerlines appropriate for ready insertion into a connector for final installation and use.

In the preferred embodiment shown in FIG. 10, an elongate rectangular dielectric carrier insert 64 has been insert molded on to carrier assembly 60, to provide an alignment and mounting subassembly for mounting terminals 12 into a connector. Carrier insert 64 is molded over terminals 12 at a point intermediate final contact portions 14 and second contact portions 20, such that the lead-in portions 16 and final contact portions 14 extend forwardly from one side of dielectric insert 64 and second contact portions 20 extend rearwardly from the opposite side. Dielectric insert 64 is provided with mounting projections 66 and 68 extending outwardly from opposed side edges of dielectirc insert 64 as shown. The subassembly comprising carrier assembly 60 and the dielectric insert 64 can be readily assembled into a connector housing such as 70 shown in FIG. 11 to form the male connector half of a matable connector.

More particularly, connector housing 70 comprises a unitary dielectric housing of generally rectangular configuration including a forward mating end 74 and a rearward terminal receiving end 72. A generally rectangular terminal receiving mounting passageway 76 extends therethrough between ends 72 and 74. As shown, two pairs of opposed mounting recesses 78 and 82 and 80 and 84 are defined in the interior vertical sidewalls defined by passageway 76 adjacent receiving end 72, adapted to receive mounting projections 66 and 68, respectively, in press-fit fashion, to fixedly mount two terminal subassemblies within passageway 76. The fully assembled dual row twist pin header male connector 85 with carrier strip 62 removed is shown in FIG. 12. The male connector 85 may be mounted on a printed circuit board member by inserting contacts 20 into a corresponding footprint on the printed circuit board and soldered to electrically connect male terminals 12 to the circuit elements on the printed circuit board.

The preferred female terminals 30 may be assembled into a female connector half, not shown, following the same methods. It will be readily apparent to those skilled in this art that the laterally offset dual opposed cantilever female terminal 30 may also be stamped to include an integral carrier strip 62 and be insert molded with the dielectric insert 64 as shown in FIG. 10 for corresponding mounting in a connector housing 70 as shown in FIG. 11, having a forward mating end which is adapted to telescopically engage the mating end 74 of the twist pin header 85 shown in FIG. 12, in a manner known to those skilled in this art.

Although an insert-molded dielectric insert 64 for the terminals 12 is shown in FIGS. 10 through 12, individual terminals may be press-fitted into terminal cavities of a connector housing as is well known to those skilled in the art. Regardless of the mounting method for mounting the terminals 12 or 30 into a dielectric housing, the low insertion force contact structure 10 of the present invention provides a reduced insertion force matable connector, which may be easily assembled in a low cost manufacturing process.

The new and improved connectors such as 85, incorporating the low insertion force contact structure 10 of the present invention, exhibit considerable compliance to pin misplacement in an X-Y type directions. During mating, the dual opposed cantilever structure in the female terminal 30 is designed so that a balancing of insertion force required to deflect each individual spring beam will occur. More particularly, if the pin misplacement is such that in order to insert the pin one of the cantilever spring beams must be deflected in a relatively overstressed manner, the other opposing spring beam will be correspondingly easier to deflect to final contact position. In this manner the system can withstand X Y type errors in pin placement, without substantially increasing the insertion force required for mating.

In an alternate embodiment, the new and improved twisted lead-in male terminals of the present invention may also be employed with conventional non-laterally spaced dual opposed spring contact female terminals and other females as well, to provide a lower insertion force contact structure than would be provided by standard radiused or chamferred square pin or rectangular pin male terminals.

More particularly, an alternate male terminal 80 in accordance with the present invention is shown in FIGS. 13–17. More particularly, alternate male terminal 80 comprises a male terminal having a substantially square cross-sectional configuration, provided with rounded corners. Male terminal 80 includes a final contact portion 84 and a forwardly extending lead-in portion 82 ending in a chamfered tip 86. By way of illustration, assume a male terminal is needed to mate with an opposed cantilever spring arm female terminal which is designed to mate with a square male pin having a mating thickness of 0.025 inch. In accordance with this invention, a male terminal 80 is provided in the form of a square male pin having a side dimension of 0.018 inch. Opposed surfaces 88,88 on the forward end of lead-in portion 82 adjacent tip 86, are separated by a distance approximately equal to 0.018 inch. Lead-in portion includes a 45 degree twist, so that opposed surfaces 90, 90 at final contact portion 84 are separated by a distance substantially equal to the diagonal of the square pin or 0.025 inch, best seen in FIG. 14.

Male terminal 80 may be manufactured by a stamping operation as was male terminal 12, or it may be formed by controlled twisting of square wire.

Figure 15:
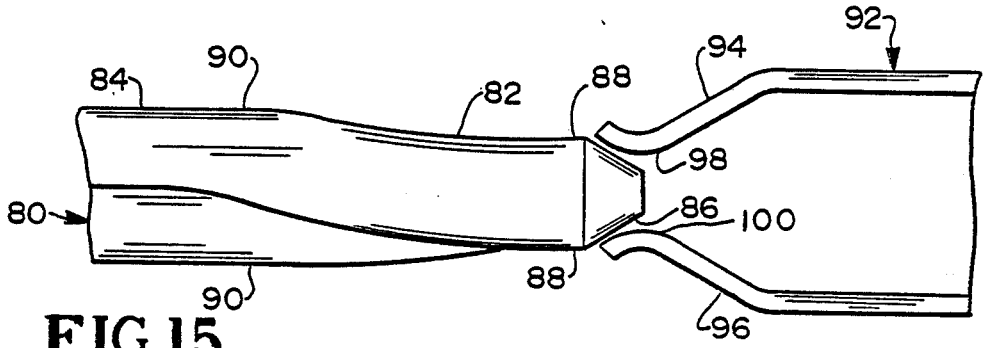
FIGS. 15–17 illustrate insertion and mating between the alternate male terminal of FIG. 13 and a standard opposed female contact.
Figure 16:
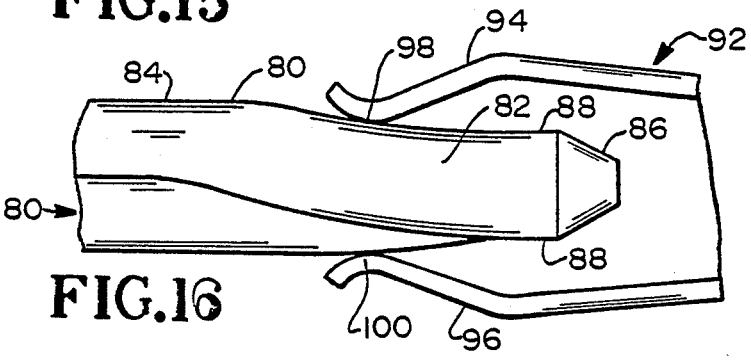
Figure 17:
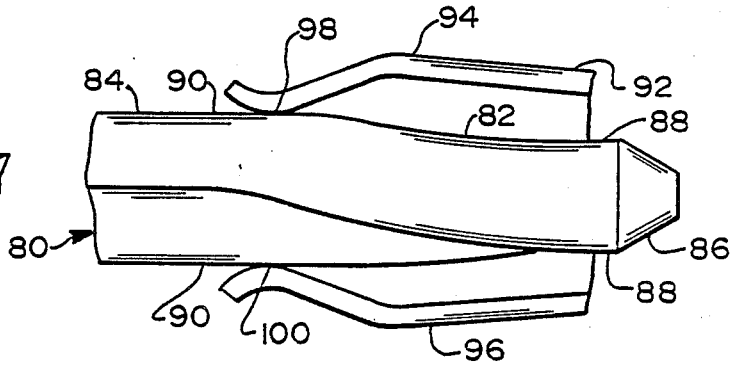

Referring now to FIGS. 15–17, alternate male terminal 80 may be used to provide low insertion force mating with a dual opposed cantilever spring arm female terminal 92 as shown. Female terminal 92 includes opposed spring arms 94 and 96 including opposed contact portions 98 and 100, respectively, which are directly opposing and not laterally offset.

As male terminal 80 is inserted into female terminal 92, female contact portions 98 and 100 are first deflected outwardly by chamfered tip 86 to the spacing of forward lead-in surfaces 88, 88. Continued insertion of male terminal 80 causes gradual deflection of female contact portions 98 and 100 along opposed surfaces 88, 88 of lead-in portion 82, as shown in FIG. 16. Gradual ouward deflection occurs on further insertion until female contact portions 98 and 100 slidingly engage opposed surfaces 90, 90 along final contact portion 84 of male terminal 80, as shown in FIG. 17.

In accordance with this alternate embodiment, female contacts 98 and 100 are deflected by chamfer 86 to a first distance apart, i.e. 0.018 inch and thereafter twisted lead-in portion 82 gradually deflects female contact portions 98 and 100 to a final mated distance apart of 0.025 inch. The alternate contact structure provides a lower insertion force in accordance with the present invetion by effectively reducing the lifting component of the insertion force required to deflect the spring arm contacts from 0.018 to 0.025 inches apart. Again the reduced peak insertion force is provided by the gradual effective slope of the twisted lead-in camming surfaces 88, 88 which act substantially perpendicularly to the lever arms 94 and 96 carrying the female contact portions 98 and 100.

Figure 19:
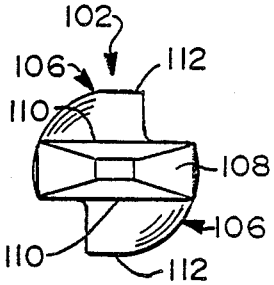
FIG. 19 is a front elevation view of the alternate male terminal shown in FIG. 18 taken along lines 19—19 thereof.
Figure 18:
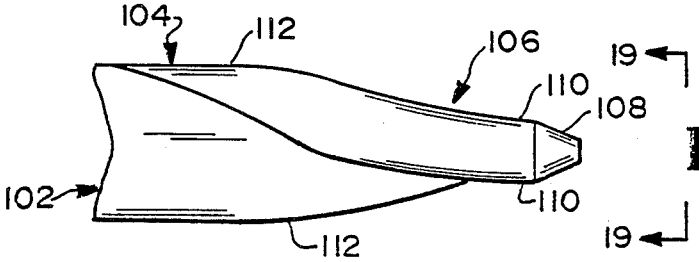
FIG. 18 is another alternate embodiment of the male terminal in accordance with the present invention.

The same beneficial low insertion force results may be obtained with a rectangular male terminal and a conventional dual opposed spring male arm female terminal as shown in FIGS. 18 and 19. As shown therein, the male terminal 102 comprises a rectangular pin having the larger cross sectional dimension approximately equal to 0.025 of an inch and a smaller cross sectional dimension. Male terminal 102 includes a final contact portion 104 including opposed surfaces 112, 112 a twisted lead-in portion 106 including opposed surfaces 110, 110 and a tip portion 108. Lead-in portion 106 includes a 90 degree twist between the chamfer tip 108 and the final contact portion 104. Opposed surfaces 110, 110 are separated by a distance substantially equal to the smaller cross sectional dimension as shown in FIG. 19. The opposed surfaces 112, 112, in the final contact region are spaced apart by the large cross-sectional dimension or 0.025 inch.

In accordance with this embodiment the opposed female contacts will first be deflected to a spaced apart distance equal to the smaller cross sectional dimension of surfaces 110, 110, adjacent the tip 108. The surfaces defined by the 90 degree twisted lead-in portion 106 will gradually deflect the female contacts to a final mating distance apart approximately equal to the spacing of surfaces 112, 112, substantially equal to the longer cross sectional dimension or 0.025 inch. In either of these alternate embodiments, a reduction in the overall insertion force required to mateably engage a male terminal within the female terminal is provided.

The new and improved low insertion force contact structure of the present invention is extremely versatile in terms of design. The length of the lead in portion and the amount of twist provided therealong can vary from application to application. The degree of twist is relatively non critical as long as an effective slope of the deflecting surface is provided which will give the desired insertion force profile. Generally the degree of twist may vary broadly between less than about 30 degrees and 90 degrees or more over the lead in portion and the length of the lead in portion can be varied with respect to the length of the pin as the particular design application requires.

Although the present invention has been described with reference to certain preferred embodiments, modifications or changes may be made therein by those skilled in this art. For example, instead of dual cantilever spring arm female terminals, other spring arm female terminals including only one spring arm contact, or as many as four, may be employed as the female terminal. The low insertion force advantages provided by substantially reducing the lifting deflection component in accordance with this invention will apply. All such obvious modifications may be made herein without departing from the scope and spirit of the present invention as defined by the appended claims.

We claim:

1. A mating electrical contact structure comprising a male terminal and a female terminal;

said male terminal being an elongate conductor having at least one surface extending the length thereof and including a final contact portion joining a forwardly extending lead-in portion, said lead-in portion having a gradual twisted cross-section relative to said final contact portion;

said female terminal including at least one spring arm with a contact portion adapted to electrically engage said surface of the male terminal;

said spring arm contact portion slidingly engaging said surface in the lead-in portion as the male terminal is inserted into the female terminal, the surface in said lead-in portion being effective to increasingly deflect the contact portion of the spring arm as the male terminal is inserted from initial position to a final position when the female contact portion is on the final contact portion of the male terminal, whereby the normal force between the contact portion of the spring arm on the surface of the male terminal gradually increases as the male terminal is inserted into the female terminal until a final mated position is achieved.

2. A contact structure as in claim 1 wherein the surface of said twisted lead-in portion defines a camming surface effective to gradually deflect the spring arm contact portion to final mated position in such manner that the peak insertion force developed during insertion of the male terminal is not substantially greater than the sliding frictional forces between the female contact portion and the final contact portion at the final stages of insertion of the male terminal.

3. A mating electrical contact structure comprising a male terminal and a female terminal;

said male terminal being an elongate conductor having a pair of opposed surfaces extending the length thereof and including a final contact portion joining a forwardly extending lead-in portion, said lead-in portion having a gradual twisted cross-section relative to said final contact portion;

said female terminal including dual cantilever spring arms with contact portions adapted to electrically engage said opposed surfaces of the male terminal;

said spring arm contact portions slidingly engaging said opposed surfaces in the lead-in portion as the male terminal is initially inserted between the spring arms, said surfaces in the lead-in portion being effective to move the contact portions of the spring arms increasingly further apart as the male terminal is inserted therein from an initial distance apart to a final distance apart when the female contact portions are on the final contact portion of the male terminal, whereby the normal forces between the contact portions of the spring arms on the surfaces of the male terminal gradually increase as the male terminal is inserted into the female terminal until a final mated position is achieved.

4. The mating contact structure of claim 3 wherein said male terminal has a four sided cross section.

5. The mating contact structure of claim 4 wherein said cross section is generally square, said initial distance is generally equal to a side of the square and the final distance is equal to the diagonal of said square.

6. The mating contact structure of claim 4 wherein said cross section is generally rectangular having a length and a smaller width, said initial distance is generally equal to said width and the final distance is generally equal to said length.

7. The mating contact structure of claim 4 wherein the contact portions are generally coplanar and laterally offset with respect to each other, said cross section is generally rectangular having a length and a smaller width, said initial distance being substantially zero and said final distance being generally equal to said width.

8. A mating electrical contact structure comprising a male terminal and a female terminal;

said male terminal being an elongate conductor having a generally four-sided cross-section and having a pair of opposed surfaces, said male terminal including a final contact portion joining a forwardly extending lead-in portion having a gradual twisted cross-section relative to said final contact portion, the opposed surfaces in said lead-in portion each defining a curved camming surface;

said female terminal including dual-cantilever spring arms with contact portions adapted to electrically engage said opposed surfaces of the male terminal; said spring arm contact portions slidingly engaging said opposed surfaces in the lead-in portion as the male terminal is initially inserted between the spring arms, said camming surfaces in the lead-in portion being effective to substantially simultaneously move the contact portions of the spring arms increasingly further apart in a gradual manner as the male terminal is inserted therein from an initial distance apart to a final distance apart when the female contact portions are on the final contact portion of the male terminal, whereby the peak insertion forces for the contact structure developed during insertion of the male terminal are not substantially greater than the sliding frictional forces between the female contact portions and the final contact portions at the final stages of insertion of the male terminal.

* * * * *